US006762539B2

(12) United States Patent
Klett et al.

(10) Patent No.: US 6,762,539 B2
(45) Date of Patent: Jul. 13, 2004

(54) SPARK PLUG FOR AN INTERNAL COMBUSTION ENGINE AND METHOD FOR PRODUCTION OF A MIDDLE ELECTRODE FOR AN INTERNAL COMBUSTION ENGINE SPARK PLUG

(75) Inventors: Dittmar Klett, Pleidelsheim (DE); Heinz Ulm, Kunreuth (DE); Simon Schmittinger, Renningen (DE); Dietrich Trachte, Leonberg (DE); Jochen Fischer, Bamberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/019,860

(22) PCT Filed: Jan. 25, 2001

(86) PCT No.: PCT/DE01/00286

§ 371 (c)(1),
(2), (4) Date: May 7, 2002

(87) PCT Pub. No.: WO01/67571

PCT Pub. Date: Sep. 13, 2001

(65) Prior Publication Data

US 2002/0149307 A1 Oct. 17, 2002

(30) Foreign Application Priority Data

Mar. 10, 2000 (DE) ..... 100 11 705

(51) Int. Cl.[7] ..... H01T 13/20
(52) U.S. Cl. ..... 313/118; 313/141
(58) Field of Search ..... 313/118, 141, 313/142, 143, 138, 144, 145; H01T 13/20

(56) References Cited

U.S. PATENT DOCUMENTS

| | | | | | |
|---|---|---|---|---|---|
| 3,958,144 | A | * | 5/1976 | Franks | 313/138 |
| 4,122,366 | A | * | 10/1978 | von Stutterheim et al. | 313/141 |
| 5,514,929 | A | * | 5/1996 | Kawamura | 313/141 |
| 5,866,973 | A | * | 2/1999 | Kagawa et al. | 313/141 |
| 5,877,584 | A | * | 3/1999 | Kato et al. | 313/143 |
| 6,078,129 | A | * | 6/2000 | Gotou et al. | 313/141 |
| 6,215,235 | B1 | * | 4/2001 | Osamura | 313/141 |

FOREIGN PATENT DOCUMENTS

EP 0 785 604 A * 7/1997 ..... H01T/13/39

* cited by examiner

*Primary Examiner*—Don Wong
*Assistant Examiner*—Trinh Vo Dinh
(74) *Attorney, Agent, or Firm*—Michael J. Striker

(57) ABSTRACT

A spark plug for an internal combustion engine includes a middle electrode which has an electrode base body (5) with an end face (51) oriented toward the combustion chamber, to which end face a precious metal platelet (8) is attached. An end section (15) of the electrode base body oriented toward the combustion chamber is formed in the shape of a truncated cone. The precious metal platelet (8) is likewise formed in the shape of a truncated cone and the diameter of the end face (52) of the electrode base body oriented toward the combustion chamber corresponds to the diameter of the end face (84) of the precious metal platelet oriented away from the combustion chamber. A method for producing middle electrodes for a spark plug of an internal combustion engine is also proposed.

12 Claims, 3 Drawing Sheets

Figure 1:
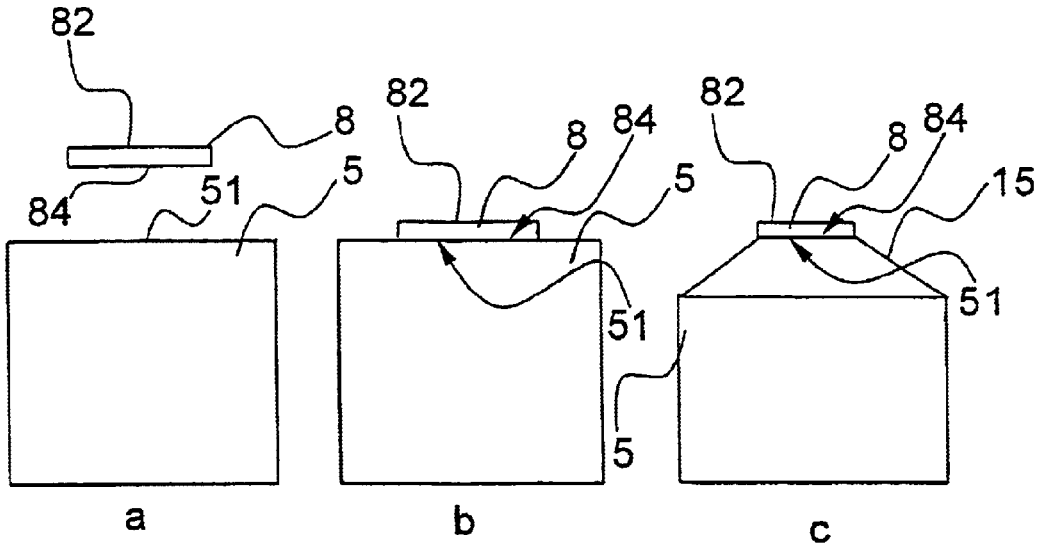

SPARK PLUG FOR AN INTERNAL COMBUSTION ENGINE AND METHOD FOR PRODUCTION OF A MIDDLE ELECTRODE FOR AN INTERNAL COMBUSTION ENGINE SPARK PLUG

PRIOR ART

The invention is based on a spark plug for an internal combustion engine and a method for producing a middle electrode as generically defined by the preambles to the independent claims. A spark plug for an internal combustion engine is already known (EP 0 785 604 B1), which has a middle electrode comprised of an electrode base body and a precious metal platelet. The precious metal platelet is attached to the end face of the electrode base body oriented toward the combustion chamber. In its end section oriented toward the combustion chamber, the electrode base body is the shape of a truncated cone. EP 0 785 604 B1 has also disclosed affixing the precious metal platelet to the end face of the electrode base body oriented toward the combustion chamber by means of laser welding or resistance welding. The precious metal platelet is comprised of a platinum-, iridium-, or platinum-based alloy. The electrode base body is comprised of a nickel alloy and has a core made of thermoconducting material.

ADVANTAGES OF THE INVENTION

The spark plug for an internal combustion engine according to the invention, with the features of the independent claim, has the advantage over the prior art that it has very favorable ignition properties since a reduced surface area reduces the amount of heat drawn away from the volume in which the mixture is to be ignited. An embodiment of this kind is inexpensive to produce.

Advantageous modifications and improvements of the spark plug disclosed in the independent claim are possible by means of measures taken in the dependent claims. It is particularly advantageous to select the opening angle of the truncated cone-shaped precious metal platelet as smaller than the opening angle of the truncated cone-shaped combustion chamber end section of the electrode base body since this minimizes material consumption for the precious metal platelet and at the same time minimizes the removal of heat from the volume in which the combustible mixture is to be ignited. It is particularly advantageous to embody the combustion chamber end section of the electrode base body in such a way that it has a first and a second truncated cone-shaped region. This further reduces the removal of heat from the volume in which the combustible mixture is to be ignited. For the correct adaptation of the opening angle to the bottom diameter of the electrode base body, it is advantageous to embody the opening angles in such a way that the opening angle of the first truncated cone-shaped region and the precious metal platelet connected to it is smaller than the opening angle of the second truncated cone-shaped region. Furthermore, it is advantageous to enlarge the combustion-resistant precious metal region, i.e. to embody the first truncated cone-shaped region and the region of the precious metal platelet adjoining it on the side oriented toward the combustion chamber in such a way that the opening angle of the first truncated cone-shaped region points toward the combustion chamber. This truncated cone-shaped region therefore widens out slightly, i.e. at an angle of up to 35°, in the direction toward the combustion chamber. Consequently, the removal of heat from the region in which the combustible mixture is to be ignited is thus not significantly increased, but an increase in the combustion resistance is achieved.

The method according to the invention for producing a middle electrode for a spark plug of an internal combustion engine, with the features of the independent claim, has the advantage over the prior art that the adhesion of the precious metal tip to the supporting material of the electrode base body is improved. Advantageous modifications and improvements of the method disclosed in the independent claim for producing a middle electrode for a spark plug of an internal combustion engine are possible by means of the measures taken in the dependent claims. It is particularly advantageous to affix the precious metal platelet to the electrode base body by means of a simple method such as resistance welding or laser welding. It is also advantageous that the combustion chamber end face of the electric base body is machined in a material-removing manner before the attachment of the precious metal platelet in such a way that the end face is flat since this results in a precisely defined attachment of the platelet and consequently a precise localization of the region between the precious metal platelet and the electrode base body. It is also advantageous to execute the material-removing machining of the precious metal platelet and the end section of the electrode base body in such a way that the combustion chamber end section of the electrode base body has a first and a second truncated cone-shaped region. On the one hand, this assures a favorable adhesion of the precious metal platelet and on the other hand, assures that the heat-dissipating surface area of the middle electrode is minimized.

DRAWINGS

Exemplary embodiments of the invention are shown in the drawings and will be explained in detail in the subsequent description.

Figure 2:
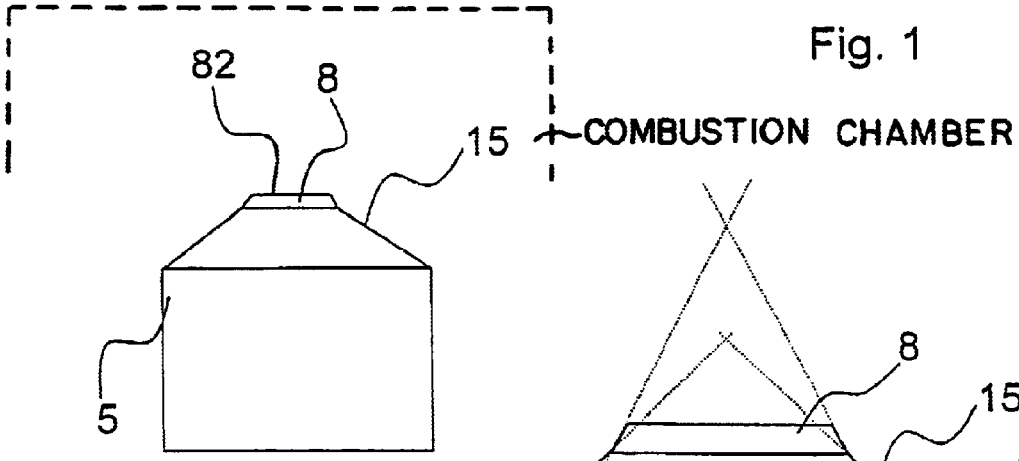
Figure 3:
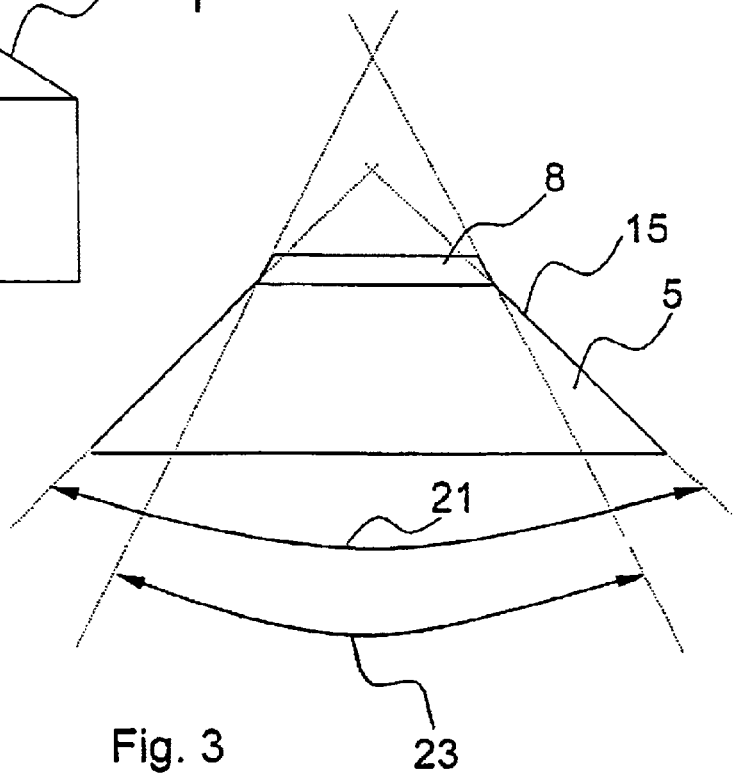
Figure 4:
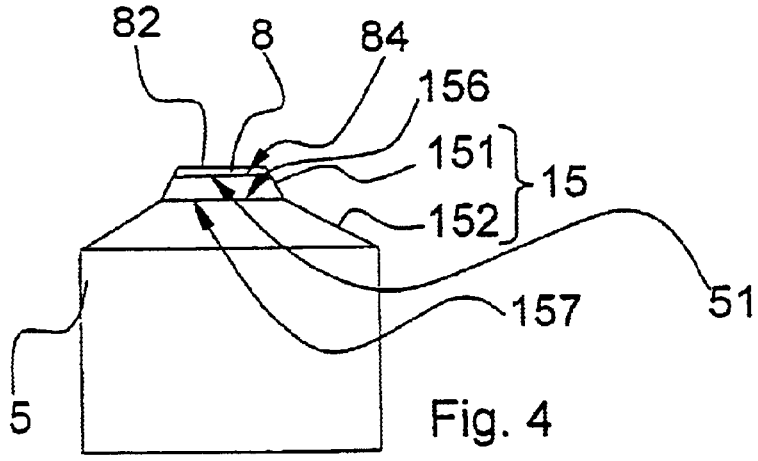
Figure 5:
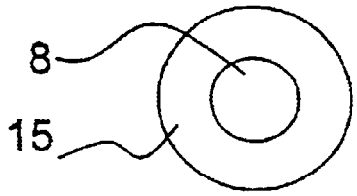
Figure 6:
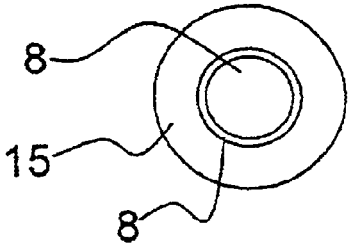
Figure 7:
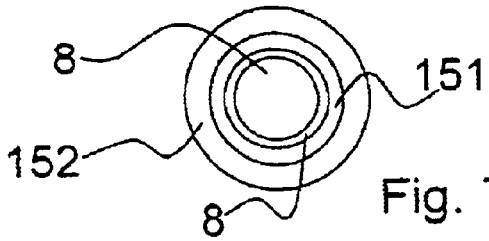
Figure 8:
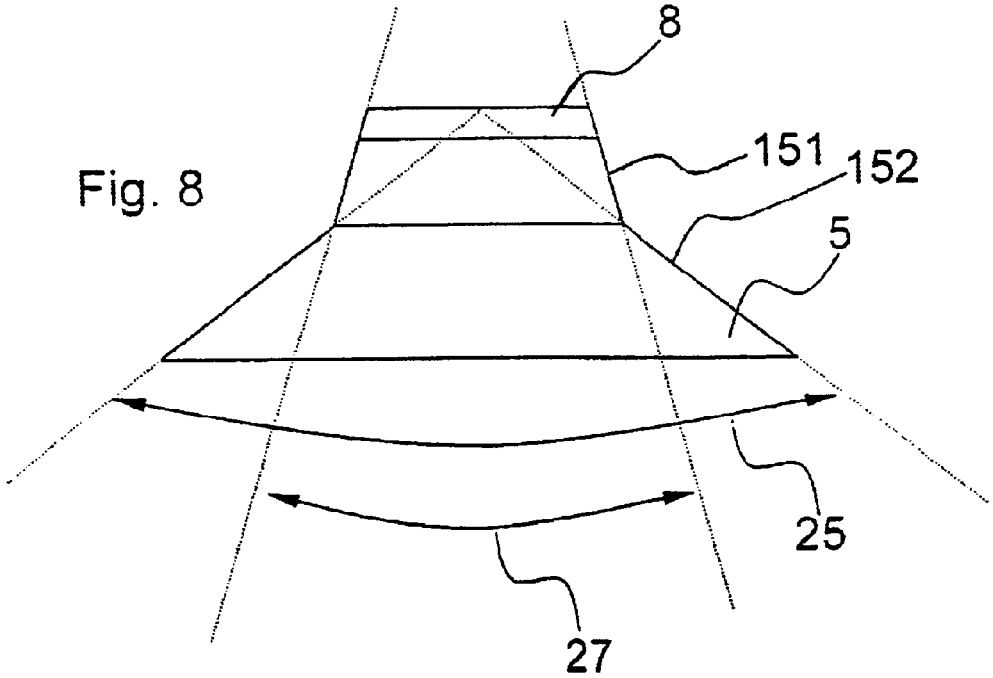
Figure 9:
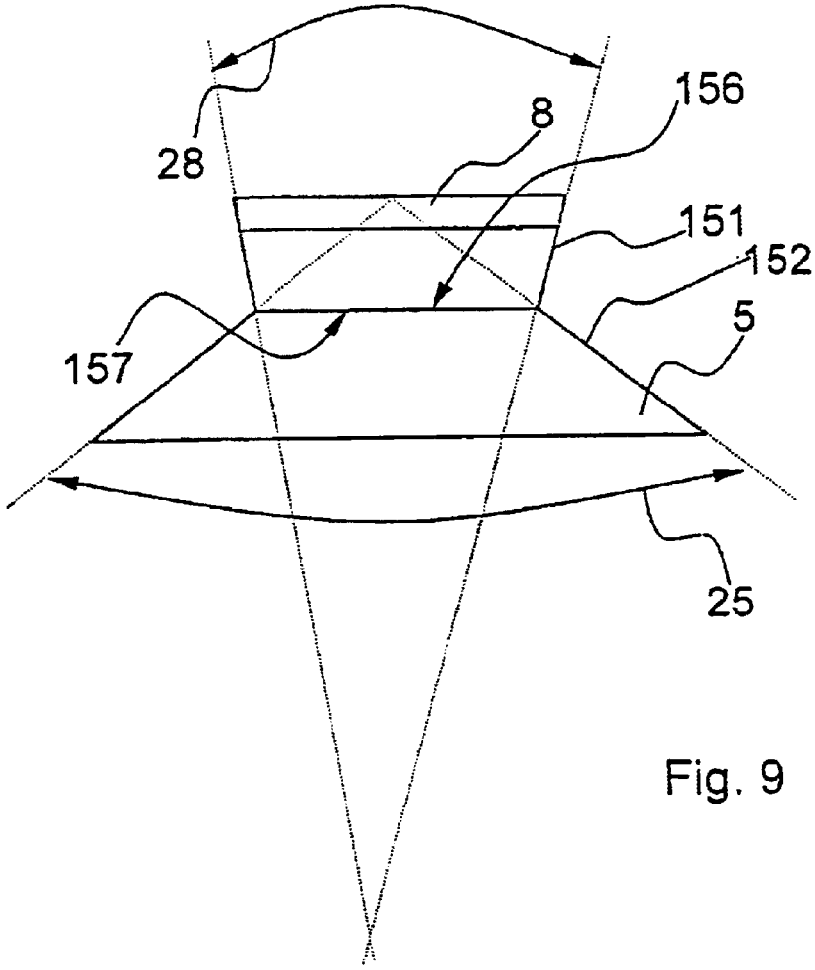
Figure 10:
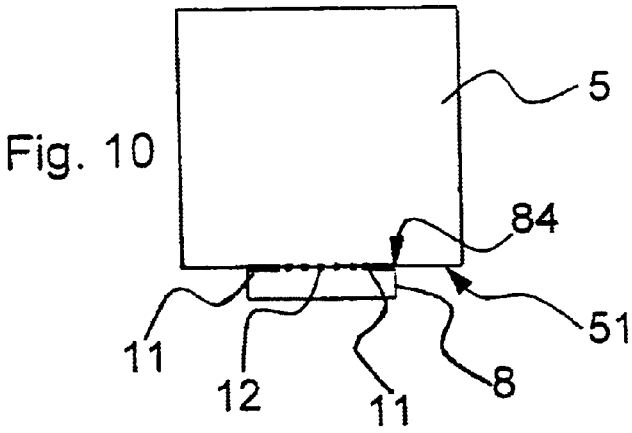
Figure 11A:
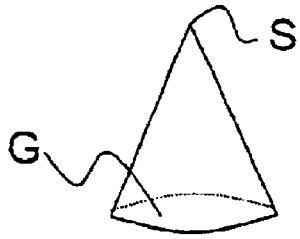
Figure 11B:
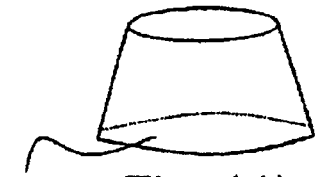

FIG. 1*a* shows a schematic longitudinal section through an electrode base body and a precious metal platelet, FIG. 1*b* shows a schematic longitudinal section through a middle electrode of a spark plug after the precious metal platelet has been attached to the electrode base body, FIG. 1*c* shows a schematic longitudinal section through a middle electrode of a spark plug according to the invention, after the precious metal platelet and the combustion chamber end section of the electrode base body have been turned on a lathe, FIG. 2 shows a schematic longitudinal section through another exemplary embodiment of a middle electrode of a spark plug according to the invention, FIG. 3 shows a schematic longitudinal section through the combustion chamber end section of the electrode base body and the precious metal platelet, FIG. 4 shows a schematic longitudinal section through another exemplary embodiment of a middle electrode of a spark plug according to the invention, FIGS. 5, 6, & 7 each show a schematic top view of a middle electrode of a spark plug according to the invention, FIGS. 8 & 9 each show schematic longitudinal sections through additional exemplary embodiments of combustion chamber end sections and precious metal platelets of a spark plug according to the invention, FIG. 10 (schematically) depicts a middle electrode of a spark plug according to the prior art, FIG. 11*a* shows a side view of a circular cone, and FIG. 11*b* shows a side view of a truncated cone.

DESCRIPTION OF THE EXEMPLARY EMBODIMENTS

The principal design of a spark plug is sufficiently known from the prior art and can be taken, for example, from the Bosch technical text "Sparkplugs", Robert Bosch GmbH 1985. According to this reference, a spark plug has a metallic, tubular housing that is radially symmetrical. An insulator is disposed extending coaxially in a central bore along the symmetry axis of the metallic housing. Inside a central bore extending along the longitudinal axis of the insulator, there is a middle electrode at the combustion chamber end, which protrudes out of the bore at the combustion chamber end of the insulator. At the end of the middle electrode oriented away from the combustion chamber, the bore of the insulator contains an electrically conductive glass melt which connects the middle electrode to the connecting bolt that is likewise disposed in the central bore of the insulator. In addition, one or more shell electrodes are disposed at the combustion chamber end of the metallic housing. The electrical energy traveling to the combustion chamber end of the sparkplug via the connecting bolt, the electrically conductive glass melt, and the middle electrode then causes a spark to arc over between the middle electrode and one or more shell electrodes, which ignite the fuel/air mixture in the combustion chamber.

As described in EP 0 785 604 B1, the middle electrode is comprised of an electrode base body and, at the combustion chamber end of the electrode base body, has a precious metal platelet which is affixed to the combustion chamber end face of the electric base body. The electrode base body is comprised of a nickel-based alloy while the precious metal platelet is comprised of platinum or iridium or a platinum-based alloy or an iridium-based alloy. FIG. 10 shows a schematic longitudinal section through a middle electrode of this kind. The reference numeral 5 indicates the electrode base body and the reference numeral 8 indicates the precious metal platelet. EP 0 785 604 B1 also describes the possibility of affixing the precious metal platelet 8 to the electrode base body 5 by means of resistance welding or laser welding.

Non-homogeneous temperature distribution and softening of the precious metal platelet during the process in which the precious metal platelet 8 is affixed to the electrode base body 5 produces two section the transition region between the electrode base body 5 and the precious metal platelet 8. There is on the one hand, an outer section which is disposed toward the outer circumference of this region; this section is shown in FIG. 10 with heavy, solid lines and is provided with the reference numeral 11. On the other hand, the transition region between electrode base body 5 and the precious metal platelet 8 has an inner section which adjoins the outer section 11 in the direction of the longitudinal axis of the precious metal platelet and the electrode base body 5 and/or is encompassed by the outer section 11. In FIG. 10, the inner section is provided with the reference numeral 12 and is indicated by a heavy, dotted line. FIG. 10 represents a schematic longitudinal section through a middle electrode. After the process that produces a connection between the precious metal platelet 8 and the electrode base body 5, the outer section 11 has a notching as well as micro-honeycombing that are caused by a non-homogeneous temperature distribution during the attachment process and the softening of the precious metal platelet. Furthermore, the diffusion zone in the outer section 11 is reduced in its vertical span compared to the inner section 12 so that the transition region between the precious metal platelet 8 and the electrode base body 5 in the outer section 11 differs in composition from the inner section 12. Because of its micro-structure and its composition, the outer section 11 is distinguished by a particularly high thermal stress. This section 11 reduces the adhesion of the precious metal platelet to the electrode base body.

FIG. 1 schematically illustrates a method according to the invention for producing a middle electrode for a spark plug in an internal combustion engine. FIG. 1*a* shows a longitudinal section through a precious metal platelet 8 embodied in the form of a disc. The end face of the precious metal platelet oriented toward the combustion chamber is provided with the reference numeral 82, while the end face of the precious metal platelet oriented away from the combustion chamber is provided with the reference numeral 84. FIG. 1*a* also shows a schematic longitudinal section through the electrode base body 5. The end face of the electrode base body oriented toward the combustion chamber is provided with the reference numeral 51. The electrode body is embodied as essentially cylindrical. FIG. 1*b* shows the middle electrode after the attachment of the precious metal platelet 8. The end face 84 of the precious metal platelet oriented away from the combustion chamber is attached to the end face 51 of the electrode base body oriented toward the combustion chamber by means of resistance welding or laser welding. In a preferred exemplary embodiment, the end face 51 of the electrode base body oriented toward the combustion chamber is machined in a material-removing manner before the welding step in such a way that the end face 51 of the electrode base body oriented toward the combustion chamber is flat. The preferred material-removing machining process can include grinding, turning, or milling. For superfinishing, processes such as honing, lapping, or polishing can also be used. After the welding, the precious metal platelet 8 and an end section 15 of the electrode base body oriented toward the combustion chamber can be conically turned on a lathe in such a way that the outer section 11 of the transition region between the precious metal platelet 8 and electrode base body shown in FIG. 10 is removed.

Turning is a material-removing method for machining rotationally symmetrical work pieces or work piece surfaces in which the work piece is rotated and the lathe chisel that machines the work piece executes an axial or radial advancing motion (with reference to the rotational axis of the work piece). Afterwards, the middle electrode has the form shown in FIG. 1*c*. The precious metal platelet 8 is reduced in diameter in comparison to the precious metal platelet shown in FIG. 1*b* and a combustion chamber end section 15 of the electrode base body has the shape of a truncated cone. The diameter of the end face 51 of the electrode base body oriented toward the combustion chamber thereby corresponds to the diameter of the end face 84 of the precious metal platelet oriented away from the combustion chamber. This assures that on the one hand, the outer section 11 has been removed and on the other hand, the surface of the middle electrode oriented toward the combustion chamber has been reduced, which results in the fact that less heat is drawn away from the volume of the combustion chamber in which the fuel/air mixture is to be ignited. This improves the ignition properties of the spark plug, particularly with regard to extremely clean mixtures.

In other exemplary embodiments of the invention, the above-described geometry of the combustion chamber end section 15 of the electrode base body and the precious metal platelet 8 is produced by means of different material-removing processes for machining work pieces, such as grinding and milling, i.e. the outer section 11 is removed by means of these different material-removing processes. For final machining or superfinishing, material-removing processes such as honing, lapping, or polishing can also be used. In a preferred exemplary embodiment, the diameter of the end face 82 of the precious metal platelet oriented toward the combustion chamber is reduced by up to 50% by the material-removing machining, i.e. in the maximal instance, the diameter of the combustion chamber end face 82 of the precious metal platelet is half as large after the material-removing machining as it was before the material-removing machining.

The term cone (the cone is also indicated as a circular cone) is understood to be a three-dimensional body which constitutes the enclosed volume of a straight line that extends through a fixed point S and travels around a circular curve. The point S, which then constitutes the vertex of the cone, is thus not disposed on the circular curve. A cone of this kind is depicted in a side view in FIG. 11*a*. If the cone is then cut in a plane parallel to the base plane G disposed opposite from the vertex, this produces a truncated cone. The truncated cone does not include the vertex of the cone, but rather the base plane G. A truncated cone of this kind is shown in FIG. 11*b*.

FIG. 2 shows another exemplary embodiment for a middle electrode of a spark plug according to the invention. This exemplary embodiment is also schematically depicted in a longitudinal section. By contrast to FIG. 1*c*, in this case, the precious metal platelet is also conically turned on a lathe, i.e. the precious metal platelet 8 likewise has the form of a truncated cone. The diameter of the end face 51 of the electrode base body oriented toward the combustion chamber corresponds to the diameter of the end face 84 of the precious metal platelet oriented away from the combustion chamber. The opening angles of the precious metal platelet 23 and the end section 21 oriented toward the combustion chamber are different, as schematically depicted in an enlarged representation in FIG. 3. Preferably, the opening angle 21 encloses an angle of up to 180° and the opening angle 23 encloses an angle of up to 90°. It has turned out to be particularly advantageous to select the opening angle 23 as being between 0 and 45° and to select the opening angle 21 as being between 80 and 110°.

FIG. 4 shows a schematic longitudinal section through another exemplary embodiment of a middle electrode of a spark plug according to the invention. In this instance, the precious metal platelet and the combustion chamber end section 15 of the electrode base body are turned on a lathe in such a way that the precious metal platelet 8 and a first truncated cone-shaped region 151 of the combustion chamber end section 15 constitutes a first truncated cone and a second truncated cone-shaped region of the combustion chamber end section constitutes a second truncated cone. Here, too, the outer section 11 has been turned on a lathe or, as mentioned above, has been machined using a different material-removing process. The diameter of the end face 51 of the electrode base body oriented toward the combustion chamber here corresponds to the diameter of the end face 84 of the precious metal platelet oriented away from the combustion chamber and the diameter of the end face 151 of the second conical region corresponds to the diameter of the end face 156 of the first conical region oriented away from the combustion chamber. This embodiment of the middle electrode results in a further reduction of the surface area drawing heat away from the volume in which the combustible mixture is to be ignited.

FIGS. 5, 6, and 7 show top views of the combustion chamber end of a middle electrode of a spark plug for internal combustion engines according to the invention. The top view according to FIG. 5 corresponds to the top view of a spark plug middle electrode according to FIG. 1*c*. In this instance, the precious metal platelet 8 has not been conically turned on a lathe or machined in a material-removing fashion by means of a different process mentioned above, but as shown in the longitudinal section in FIG. 1*c*, has a cylindrical form with circumference lines extending parallel to the longitudinal axis of the middle electrode. As shown in FIG. 5, thee precious metal platelet is concentrically disposed. FIG. 6 corresponds to a top view of a spark plug middle electrode according to FIG. 2. Here, the precious metal platelet 8 is embodied in the shape of a truncated cone so that the circumference surfaces of this truncated cone-shaped precious metal platelet are depicted as a circular ring in the top view. FIG. 7 shows a top view of a combustion chamber end of a spark plug middle electrode according to FIG. 4. Analogous to FIG. 6, the precious metal platelet, i.e. its end face oriented toward the combustion chamber, is shown in the form of a circle and its circumference surface is shown in the form of a circular ring. This is adjoined externally by the circular ring that represents the circumference surface of the first truncated cone-shaped region 151 and a circular ring disposed further toward the outside that represents the second truncated cone-shaped region 152.

In FIG. 8, the precious metal platelet 8 and the combustion chamber end section of the electrode base body with the first truncated cone-shaped region 151 and the second truncated cone-shaped region 152 are schematically depicted once again in an enlarged longitudinal section. The opening angle of the first truncated cone comprised of the precious metal platelet 8 and the first truncated cone-shaped region 151 and the opening angle of the second truncated cone-shaped region 152 are also shown. The opening angle of the second truncated cone-shaped region 152 is labeled with the reference numeral 25 and the opening angle of the first truncated cone is labeled with the reference numeral 27. The opening angles are embodied in such a way that the opening angle 25 is less than 180° and the opening angle 27 is less than 90°. In trials, it has turned out to be particularly advantageous to select the opening angle 27 as being between 0 and 45° and to select the opening angle 25 as being between 80 and 110°. This assures a particularly advantageous embodiment of the spark plug middle electrode which particularly minimizes the withdrawal of heat from the volume in which the combustible mixture is to be ignited.

And the preferred exemplary embodiment of a middle electrode of a spark plug according to the invention will now the described in conjunction with FIG. 9. Analogous to FIG. 8, the precious metal platelet 8 is shown here, too, along with the first truncated cone-shaped region 151 and the second truncated cone-shaped region 152. The opening angle 28 of the first truncated cone, which is comprised of the truncated cone-shaped region 151 and the precious metal platelet 8, points toward the combustion chamber, while the opening angle 25 of the second truncated cone-shaped region 152, analogous to the opening angles shown in FIGS. 3 and 8, point toward the end of the spark plug middle electrode oriented away from the combustion chamber. Analogous to FIG. 4, the diameter of the end face 51 of the electrode base body oriented toward the combustion chamber corresponds to the diameter of the end face 84 of the precious metal platelet oriented away from the combustion chamber and the diameter of the end face 157 of the second truncated cone-shaped region oriented toward the combustion chamber corresponds to the diameter of the end face 156 of the first conical region oriented away from the combustion chamber. The opening angle 28 is up to 25°; preferably the opening angle 27 is selected as being between 3 and 10°. This assures that the combustion-resistant region embodied by the precious metal platelet 8 is enlarged despite the only very slight increase in the surface area of the combustion chamber end of the middle electrode.

One preferred exemplary embodiment is distinguished in that the height of the first truncated cone-shaped region 151, together with the height of the precious metal platelet 8, is less than or equal to 1.5 mm. In a particularly preferred exemplary embodiment, the height of the first truncated cone-shaped region 151, together with the height of the precious metal platelet (reference numeral 8), is 0.4 to 1.0 mm. This embodiment assures both a high combustion resistance and a low heat withdrawal from the volume in which the fuel/air mixture is to be ignited. A heat dissipation required for proper functioning is also assured. This is additionally achieved by virtue of the fact that the diameter of the end face 82 of the precious metal platelet oriented toward the combustion chamber is less than or equal to 1.5 mm. In a particularly preferred embodiment, the diameter of the end face 82 of the precious metal platelet oriented toward the combustion chamber is between 0.5 and 1.0 mm.

The spark plug according to the invention assures a very long service life of the spark plug through the use of a precious metal platelet at the combustion chamber end of the middle electrode. The adhesion of the precious metal cap here is improved by virtue of the fact that the outer section 11 is removed by lathe turning during the manufacture of the spark plug middle electrode and consequently cannot influence the adhesion of the precious metal platelet to the electrode base body. Furthermore, the embodiment of the combustion chamber end of the middle electrode shown, due to its small surface area, prevents excessive heat from being drawn away from the volume in which the combustible mixture is to be ignited. It is inexpensive to manufacture the spark plug electrode in the manner explained above.

What is claimed is:

1. A spark plug for an internal combustion engine having a combustion chamber, comprising a middle electrode having an electrode base body (5) with an end face (51) oriented toward the combustion chamber, wherein a precious metal platelet (8) is attached to the end face, wherein an end section (15) of the electrode base body oriented toward the combustion chamber is formed in the shape of a truncated cone in said precious metal platelet (8), wherein the previous metal platelet (8) is formed as a three-dimensional body in the shape of a truncated cone and the diameter of the end face (51) of the electrode base body oriented toward the combustion chamber corresponds to a diameter of a planar end face (84) of the precious metal platelet oriented away from the combustion chamber.

2. The spark plug according to claim 1, wherein the opening angle (21) of the truncated cone-shaped end section of the electrode base body oriented toward the combustion chamber is less than or equal to 180° and/or the opening angle (23) of the truncated cone-shaped precious metal platelet is less than or equal to 90° and the opening angle of each opens in the direction oriented away from the combustion chamber.

3. The spark plug according to claim 1, wherein the end section (15) of the electrode base body oriented toward the combustion chamber has a first truncated cone-shaped region (151) and a second truncated cone-shaped region (152), wherein a diameter of the end force (156) of the first truncated cone-shaped region oriented away from the combustion chamber corresponds to a diameter of the end face (157) of the second truncated cone-shaped region oriented toward the combustion chamber.

4. The spark plug according to claim 3, wherein an opening angle (27) of the first truncated cone-shaped region and of the precious metal platelet adjoining in the direction of the combustion chamber is less than or equal to 90° and/or an opening angle (25) of the second truncated cone-shaped region is less then 180° and the opening angle of each opens in a direction oriented away from the combustion chamber.

5. The spark plug according to claim 3, wherein the opening angle (28) of the first truncated cone-shaped region and the precious metal platelet adjoining the first truncated cone-shaped region in the direction toward the combustion chamber is less then or equal to 25° and the opening angle opens in the direction oriented toward the combustion chamber.

6. The spark plug according to claim 3, wherein a height of the first truncated cone-shaped region (151), together with the height of the precious metal platelet (8), is less than or equal to 1.5 mm.

7. The spark plug according to claim 3, wherein the diameter of the end face (82) of the precious metal platelet oriented toward the combustion chamber is less then or equal to 1.5 mm.

8. A method for producing middle electrodes for a spark plug of an internal combustion engine having a combustion chamber, in which a precious metal platelet (8) is attached to an electrode base body (5), an end face (51) of the electrode base body oriented toward the combustion chamber being attached to an end face (84) of the precious metal platelet oriented away from the combustion chamber so that a transition region between the precious metal platelet (8) and the electrode base body (5) is produced, wherein the precious metal platelet (8) and a combustion chamber end (15) of the electrode base body are machined in a material-removing manner in such a way that an outer section (11) in the transition region between the precious metal platelet (8) and the electrode base body (5) is removed, wherein said outer section (11) differs in a micro-structure and/or composition from a micro-structure and/or composition of an inner section (12) of the transition region.

9. The method according to claim 8, wherein the precious metal platelet (8) is attached to the electrode base body (5) by means of resistance welding or laser welding.

10. The method according to claim 8, wherein before attachment of the precious metal platelet (8), the end face (51) of the electrode base body oriented toward the combustion chamber is machined in a material-removing manner in such a way that the end face oriented toward the combustion chamber is flat.

11. The method according to claim 8. wherein the precious metal platelet (8) and the end section (15) of the electrode base body oriented toward the combustion chamber are machined in a material-removing manner in such a way that a first truncated cone-shaped region (151) and a second truncated cone-shaped region (152) are produced, such that the diameter of the end face (156) of the first truncated cone-shaped region oriented away from the combustion chamber corresponds to the diameter of the end face (157) of the second truncated cone-shaped region oriented toward the combustion chamber.

12. A spark plug for an internal combustion engine having a combustion chamber, comprising a middle electrode having an electrode base body (5) with an end face (51) oriented toward the combustion chamber, wherein a precious metal platelet (8) is attached to the end face, wherein an end section (15) of the electrode base body oriented toward the combustion chamber is formed in the shape of a truncated cone in said precious metal platelet (8), wherein the previous metal platelet (8) is formed in the shape of a truncated cone and the diameter of the end face (51) of the electrode base body oriented toward the combustion chamber corresponds to a diameter of an end face (84) of the precious metal platelet oriented away from the combustion chamber, wherein the end section (15) of the electrode base body oriented toward the combustion chamber has a first truncated cone-shaped region (151) and a second truncated cone-shaped region (152), wherein a diameter of the end face (156) of the first truncated cone-shaped region oriented away from the combustion chamber corresponds to a diameter of the end face (157) of the second truncated cone-shaped region oriented toward the combustion chamber.

* * * * *